US010059409B2

(12) United States Patent
Hoogeveen et al.

(10) Patent No.: US 10,059,409 B2
(45) Date of Patent: Aug. 28, 2018

(54) TAUT INVERTED CATENARY MOORING SYSTEM

(71) Applicant: Single Buoy Moorings, Inc., Marly OT (CH)

(72) Inventors: Swanik Maas Hoogeveen, Katy, TX (US); Jack Pollack, Camarillo, CA (US)

(73) Assignee: Single Buoy Moorings, Inc., Marly (CH)

( * ) Notice: Subject to any disclaimer, the term of this patent is extended or adjusted under 35 U.S.C. 154(b) by 416 days.

(21) Appl. No.: 14/875,850

(22) Filed: Oct. 6, 2015

(65) Prior Publication Data

US 2016/0101831 A1 Apr. 14, 2016

Related U.S. Application Data

(60) Provisional application No. 62/061,838, filed on Oct. 9, 2014, provisional application No. 62/235,907, filed on Oct. 1, 2015.

(51) Int. Cl.
*B63B 22/02* (2006.01)
*B63B 21/50* (2006.01)

(52) U.S. Cl.
CPC ..... *B63B 22/02* (2013.01); *B63B 21/502* (2013.01); *B63B 21/508* (2013.01); *B63B 22/025* (2013.01); *B63B 2022/028* (2013.01)

(58) Field of Classification Search
CPC ..... B63B 22/02; B63B 22/025
USPC ..... 441/3
See application file for complete search history.

(56) References Cited

U.S. PATENT DOCUMENTS 3,269,047 A * 8/1966 Slattery ..... A01K 73/04 43/44.91
3,382,540 A * 5/1968 Van Der Steen ..... B22F 3/03 425/414
4,721,053 A * 1/1988 Brewerton ..... B63B 21/50 114/230.13
5,159,891 A * 11/1992 Lohr ..... B63B 21/20 114/230.2
5,330,293 A * 7/1994 White ..... B63B 21/502 405/211
5,704,307 A * 1/1998 Treu ..... B63B 21/50 114/230.13
7,244,155 B1 * 7/2007 Nye ..... B63B 22/04 441/23
8,382,540 B2 * 2/2013 Barnard ..... B63B 22/04 254/361

(Continued)

*Primary Examiner* — S. Joseph Morano
*Assistant Examiner* — Jovon E Hayes
(74) *Attorney, Agent, or Firm* — Blank Rome LLP

(57) ABSTRACT

A Taut-Inverted-Catenary (TIC) mooring system may be implemented using only field-proven components. The mooring lines yield a positive uplift force on the anchors in all conditions. In the inverted-catenary configuration, geometric stiffness is provided by a subsurface spring buoy or distributed buoyancy elements on the line. The TIC system consists as much as possible of light-weight components, such as polyester fiber rope. Since the uplift force on the anchor is always positive, clearance between polyester rope and the seabed is provided. All geometric stiffness is provided by the spring buoy. Therefore, a ground chain between the seafloor anchor and the fiber rope is not necessary.

25 Claims, 3 Drawing Sheets

(56) References Cited

U.S. PATENT DOCUMENTS

| | | | | |
|---|---|---|---|---|
| 9,003,994 | B2 * | 4/2015 | Leverette | B63B 21/00 114/230.24 |
| 9,038,558 | B2 * | 5/2015 | Balleraud | B63B 22/025 114/230.15 |
| 9,315,241 | B2 * | 4/2016 | Carrico | B63B 21/508 |
| 2007/0163481 | A1 * | 7/2007 | Vedeld | B63B 27/24 114/230.13 |
| 2008/0311804 | A1 * | 12/2008 | Bauduin | B63B 21/50 441/23 |
| 2009/0209154 | A1 * | 8/2009 | Lunde | B63B 22/023 441/5 |
| 2011/0237142 | A1 * | 9/2011 | Hovik | B63B 21/08 441/3 |
| 2012/0040573 | A1 * | 2/2012 | Davidson | B63B 21/507 441/4 |
| 2014/0026796 | A1 * | 1/2014 | Leverette | B63B 21/00 114/230.24 |
| 2016/0101831 | A1 * | 4/2016 | Hoogeveen | B63B 21/502 441/3 |

* cited by examiner

TAUT INVERTED CATENARY MOORING SYSTEM

CROSS-REFERENCE TO RELATED APPLICATIONS

This application claims the benefit of U.S. Provisional Application No. 62/061,838, filed on Oct. 9, 2014, and U.S. Provisional Application No. 62/235,907, filed on Oct. 1, 2015. The content of each of these provisional applications is hereby incorporated by reference in its entirety.

STATEMENT REGARDING FEDERALLY SPONSORED RESEARCH OR DEVELOPMENT

Not Applicable

BACKGROUND OF THE INVENTION

1. Field of the Invention

The present invention generally relates to mooring systems for offshore floaters. More particularly, it relates to mooring systems having subsea spring buoys and adapted for use with submersible floaters.

2. Description of the Related Art Including Information Disclosed Under 37 CFR 1.97 and 1.98

The two main mooring system concepts usable for deep water are semi-taut and taut systems. A taut system always has a positive uplift force on the anchor in any (non-damaged) condition and has limited geometric stiffness, i.e., the stiffness of the system is mostly determined by the stiffness of the line material. Typically, the line material has a relative high strength-to-weight ratio.

The taut mooring systems of the prior art have not been used in a disconnectable mooring system, such as a Buoyant Turret Mooring system. Moreover, the taut mooring systems of the prior are have not been used in combination with spring buoys.

A Buoyant Turret Mooring (BTM) is a disconnectable turret mooring system comprising a disconnectable mooring buoy and a fixed turret structure located in the forepeak of a floating vessel such as a tanker. The mooring buoy is fixed to the seabed by catenary anchor legs, supports the crude oil and gas risers, and is connected by means of a structural connector to the fixed turret. The fixed turret extends up through the tanker, supported on a weathervaning bearing and contains the reconnection winch, flow lines, control manifolds and fluid swivels located above the main deck. (APL systems do not necessarily have swivels above the main deck.)

These systems have been developed for areas where typhoon, hurricane or icebergs are a danger for an FPSO or FSO and, primarily for safety reasons, rapid disconnection/reconnection is required.

Disconnection and reconnection operations may be carried out from the tanker without external intervention. When disconnected, the mooring buoy sinks to neutral buoyancy under water and the FPSO can sail away.

A Floating Production Storage and Offloading system (FPSO) is a floating facility typically installed on the surface above or close to an offshore oil and/or gas field to receive, process, store and export hydrocarbons. It comprises a floater, which is often a converted tanker, permanently moored on site. The cargo capacity of the vessel is used as buffer storage for the oil produced. The process facilities (topsides) and accommodations are installed on the floater.

The mooring configuration may be of the spread mooring type or a single point mooring system, generally a turret.

The high pressure mixture of produced fluids is delivered to the process facilities mounted on the deck of the tanker, where the oil, gas and water are separated. The water is discharged overboard or reinjected into the reservoir after treatment to eliminate contaminants. The stabilized crude oil is stored in the cargo tanks and subsequently transferred into shuttle tankers either via a CALM buoy or by lying side-by-side or in tandem to the FPSO. The gas may be used for enhancing the liquid production through gas lift, and/or for energy production onboard the vessel. The remainder of the gas may be compressed and transported by pipeline to shore or reinjected into the reservoir.

A Catenary Anchor Leg Mooring (CALM) is a floating buoy that performs the dual function of keeping a shuttle tanker moored on a single point and transferring fluids (generally crude oil or refined products) while allowing the ship to weathervane. It consists of a circular floating buoy anchored by means of multiple chain/polyester legs fixed to the seabed by either conventional anchor legs or piles. The buoy itself is free to move up and down, sideways and in pitching and rolling motions. The shuttle tanker is moored via hawsers to the turntable on the buoy. The tanker may be loaded or offloaded by means of flexible marine hoses from the buoy to the vessel's manifold. The connection between the piping inside the buoy and the subsea pipeline may be by means of flexible hoses.

In a Turret Mooring System, the turret system is integrated into (internal turret) or attached to the hull of the tanker, in most cases near the bow, (external turret) and allows the tanker to weathervane around it and thereby take up the line of least resistance to the combined forces of wind, waves and current. A high pressure oil and gas swivel stack is mounted onto the mooring system. This swivel stack is the connection between the risers from the subsea flowlines on the seabed to the piping onboard the vessel. It allows the flow of oil, gas and water onto the unit to continue without interruption while the FPSO weathervanes. For reasons of size and cost, the number of swivels is kept to a minimum, and therefore the flow of oil and gas has to be manifolded in the turret area, particularly when the system produces from a large number of separate wells.

The turret mooring and high pressure swivel stack are thus essential components of an FPSO.

A Single Point Mooring (SPM) is a mooring system which enables the vessel to weathervane whilst it loads or unloads hydrocarbons, chemicals or fresh water. The two categories of SPMs are:

- a single point mooring buoy or tower that is designed for use by any trading shuttle tanker, and is thus independent of the vessel;
- a system, such as a turret mooring, that is incorporated within a vessel such as an FSO or FPSO.

A semi-taut mooring system is a combination of two segments that have different properties. The first segment is connected to the anchor. This segment has a lower strength-to-weight ratio and most commonly is a chain. It provides geometric stiffness though catenary behavior and lay-down on the sea bed. It decreases vertical loads on the anchor and prevents the second segment from touching the sea bed.

In a semi-taut mooring system, one end of the second segment is connected to the first segment and the other end is connected to the floater. This segment has a higher strength-to-weight ratio, like polyester fiber rope, and therefore exhibits limited catenary behavior. The main contribution to stiffness from this segment is the stiffness of the material. For a semi-taut mooring system, the total line stiffness therefore is determined by both the material stiffness and geometric stiffness.

The disconnectable mooring systems of the prior art comprise a semi-taut mooring system, in some cases aided by spring buoys in the top segment. For these systems, geometric stiffness is determined by two effects: the catenary behavior of the bottom segment and the influence on line geometry by the spring buoy. These two effects are antagonists, decreasing one another's effectiveness.

BRIEF SUMMARY OF THE INVENTION

A Taut-Inverted-Catenary (TIC) mooring system according to the present invention may be implemented using only existing, field-proven components. "Taut" means that the mooring lines yield a positive uplift force on the seafloor anchors in all conditions. "Inverted-Catenary" means that geometric stiffness is provided by a buoyant element that can be distributed, but preferably is a single buoyancy element on the line. Such a buoyancy element is called a spring buoy, as it is buoyant and provides geometric stiffness, in the manner of a spring.

For a Taut-Inverted-Catenary system, the stiffness is determined by both the material stiffness and geometric stiffness. In a mooring system according to the invention, it is not the catenary behavior of weight, but the behavior of the line due to buoyancy that provides the geometric stiffness.

A TIC system according to the invention may consist as much as possible of light-weight components, such as polyester fiber rope. Since the uplift force on the anchor is always positive, clearance between the polyester rope and the seabed is provided by the geometry of the system. All geometric stiffness is provided by the spring buoy. Therefore, a ground chain between the anchor [or short anchor chain] and the fiber rope is not necessary and thus there is no ground chain to affect the system stiffness.

The termination of a mooring leg to an anchor is often designed to be subsurface. When a semi taut mooring chain is attached subsurface this chain continues for some length as the ground chain, which is occasionally lifted. In the TIC system of the present invention, when the mooring termination is subsurface, a similar mooring chain may be attached to the anchor. With the TIC system this subsurface chain may be terminated just above the seafloor and the buoyant force in the mooring leg will keep this chain and connection to the polyester mooring rope above the seafloor. If the anchor to mooring leg connection is above the seafloor, the TIC polyester connection may be directly to the anchor and no chain need be used.

The TIC system of the invention may be used for standard deep water mooring purposes of any kind. It has particular advantages when used in combination with a disconnectable system, such as a Buoyant Turret Mooring (BTM) system, because of the superlative behavior of the system in disconnected conditions wherein a horizontal force is encountered—e.g., an offsetting current.

BRIEF DESCRIPTION OF THE SEVERAL VIEWS OF THE DRAWING(S)

DETAILED DESCRIPTION OF THE INVENTION

Figure 1:
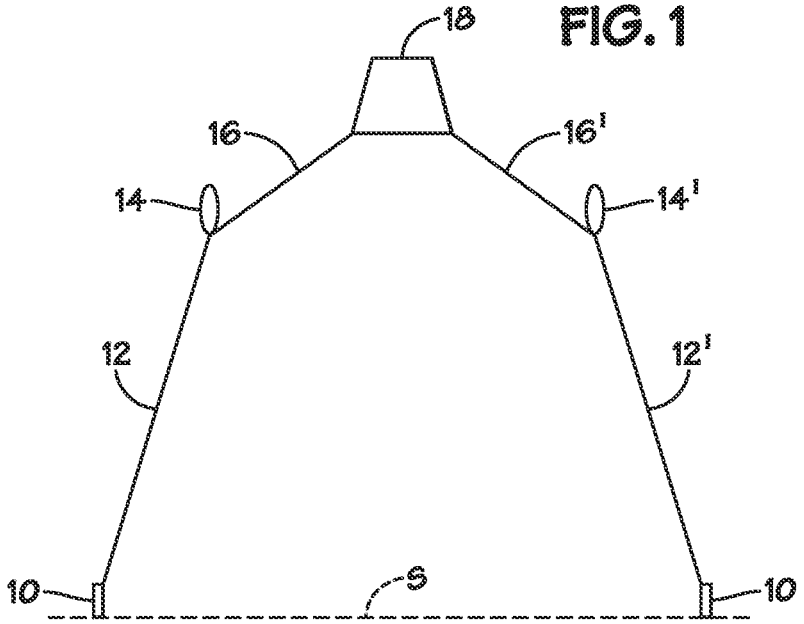
FIG. 1 is a schematic diagram of a disconnected BTM buoy having a TIC mooring system according to the invention in still water.

The invention may best be understood by reference to the exemplary embodiment(s) illustrated in the drawing figures wherein the TIC mooring system is depicted in the disconnected condition and under influence of four different load cases. The load cases are stated in the preceding section. In each situation equilibrium has been reached. Although for explanatory purposes the drawings are not to scale, the shapes are realistic. For clarity, the illustrations show only two mooring lines with their associated anchor piles and spring buoys. However, in practice, it should be understood that a mooring system according to the invention would have at least three mooring lines (legs).

The seafloor anchor to which each [lower] mooring line connects may be any suitable device having a total holding power sufficient to remain fixed on the seafloor. Non-limiting examples of suitable anchoring devices include: driven piles; suction anchors [or piles]; and, suction embedded plate anchors. It will be appreciated by those skilled in the art that the holding power of the anchor may be achieved by hooking/suction, sheer weight, or by a combination of both factors.

In a TIC system according to the invention, the geometric stiffness of the spring buoy is combined with a positive uplift on the anchor. Spring buoys have been used in mooring systems for at least two decades. However, every known application of spring buoys has been in combination with a semi-taut mooring system—i.e., a mooring system comprising one or more ground chains.

A TIC system according to the invention has superior characteristics in terms of restoring force curve and line load curve compared to both a semi-taut (ST) mooring system and a taut mooring system. Therefore a TIC system according to the invention yields both smaller offsets and smaller line loads than state-of-the-art systems.

When used in combination with a disconnectable system, such as a Buoyant Turret Mooring (BTM), a TIC system according to the invention has superior characteristics when disconnected as well. A TIC system according to the invention system has a low coupling between horizontal restoring force and vertical down-pull. Therefore, it can accommodate larger horizontal forces, due to currents for instance, while only minimally increasing the depth of the buoy. This leads to smaller equilibrium depths and larger allowable damaged compartments. Both of these factors have a beneficial effect on buoy design.

A TIC system according to the invention is inherently robust in the disconnected case. Even when the buoy has sunk to greater depths than it was designed for, a TIC system according to the invention still has residual vertical stiffness preventing the buoy from sinking further. The net force on the buoy may even become positive upward, when the buoy has sunk below the spring buoys.

Because of the high vertical stiffness, a TIC system according to the invention is suited for use in combination with an SCR riser system and a steel buoy BTM. No hybrid risers are necessary because the required vertical stiffness is induced by the mooring system. Therefore, the riser system may have constant vertical payload, independent of buoy depth. A steel BTM buoy may be used because a TIC system according to the invention yields small equilibrium depth and allows for large compartment size, thus no foam filling is necessary.

The costs of a TIC mooring system according to the invention may be comparable but slightly lower than the costs of a semi-taut mooring system with spring buoys. The larger benefit of a TIC system is in the effects on BTM buoy design and, in turn, the follow-on effects due to a smaller-sized BTM buoy.

A TIC system according to the invention moderates the requirements on the BTM system buoy; the buoy structure can allow for smaller external pressure and can consist of larger compartments. Therefore, the buoy may have a lower structural density and thus the buoy may be smaller, yet reach a similar payload capacity.

A smaller BTM buoy has many follow-on benefits, some of which are: a smaller buoy is less expensive to build; and, a smaller buoy behaves better during reconnection and disconnection. Therefore, the requirements on the equipment required for these operations, such as heave compensation, are lessened.

Also, prefilling the turret with water above the buoy to enhance disconnection from a floating vessel may not be required, thus shortening the time required for disconnection. A smaller buoy is easier to install and may not require a large heavy-lift vessel. For transport, wet towing may be preferred due to better stability. The smaller mooring line loads ease the requirements on the structural connectors.

It will be appreciated by those skilled in the art that a TIC system according to the invention has at least two general embodiments: 1) a mooring system (TIC) consisting of fiber rope and a spring buoy that maintains a positive uplift force on the anchor; and, 2) such a mooring system applied to a (disconnectable) BTM. Currently, the second embodiment is the most effective way known to Applicants of mooring a BTM. The first embodiment may be useful in other applications such as with a MoorSpar™ mooring buoy or for the lateral mooring system of a tension leg platform (TLP).

Unlike the taut leg mooring systems of the prior art (see, e.g., U.S. Pat. No. 5,704,307 to Treu et al.), a TIC according to the invention is a mooring system comprising at least three mooring lines. In all applications and conditions, these mooring lines are connected to each other, either through a buoy (floating subsurface) or a vessel (floating on surface). The taut leg mooring systems of the prior art have a single mooring line which is individually disconnectable.

The individual mooring lines of a TIC system according to the invention consist of a series of several mooring lines which are interconnected, yielding a geometry different from a vertical line (such as the taut leg mooring systems of the prior art when disconnected). This geometry results in the total vertical force at the anchor always being greater than zero. This is the case inasmuch as the buoyancy of the buoy minus the weight in water of the mooring line is greater than zero.

A TIC system according to the invention is fully subsurface—no part reaches the water line. Unlike the taut leg mooring systems of the prior art, the TIC system of the present invention does not rely on the presence of a water surface. Also, unlike the taut leg mooring systems of the prior art, no part of the TIC mooring system can go slack.

It will be appreciated that the upper line of a TIC mooring system according to the first embodiment connects directly to a vessel, unlike the taut leg mooring systems of the prior art which connect to a surface buoy first.

In a TIC mooring system according to the second embodiment, the BTM buoy is connected directly to a vessel, unlike the taut leg mooring systems of the prior art which are connected to a vessel by a hawser line.

Referring first to FIG. 1, BTM buoy 18 is depicted in a disconnected, subsurface state. A plurality of mooring legs connect buoy 18 to seafloor anchors 10. The mooring legs comprise lower mooring lines 12 which connect between a seafloor anchor 10 and a subsea buoyancy element—spring buoys 14 in the illustrated embodiment. The mooring legs additionally comprise upper mooring lines 16 which connect between the buoyancy element—spring buoys 14 in the illustrated embodiment—and BTM buoy 18.

In certain preferred embodiments, upper mooring lines 16 and lower mooring lines 12 comprise (or consist essentially of) synthetic fiber. Examples of suitable synthetic fibers include polyester, DYNEEMA® polyethylene fibers (DSM High Performance Fibers B. V. Eisterweg 3 6422 PN Heerlen Netherlands), and aramid fibers. In some embodiments, the synthetic fiber mooring lines may be approximately neutrally buoyant in seawater. In yet other embodiments, upper (16) and lower (12) mooring lines may comprise wire rope or chain or have selected segments comprising wire rope or chain.

Figure 2:
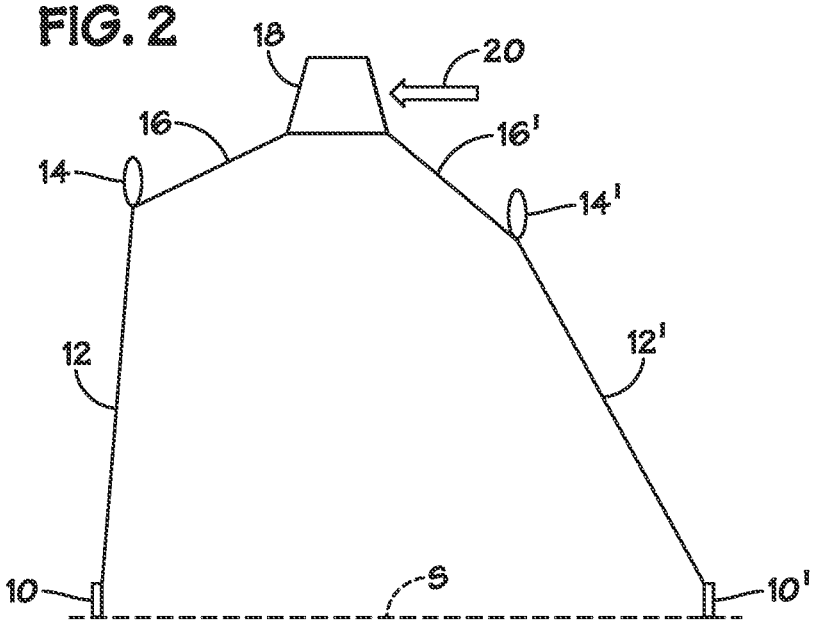
FIG. 2 is a schematic diagram of the disconnected BTM buoy illustrated in FIG. 1 with a current load.

Referring now to FIG. 2, the mooring system depicted in FIG. 1 is shown under the influence of a subsurface current. This is shown as current vector 20. Current vector 20 acts to displace BTM buoy 18 to the left in FIG. 2. It will be noted that this displacement results in lower mooring line 12 becoming more vertical; spring buoy 14 rising; lower mooring line 12' assuming a more acute angle (relative to the seafloor); and, spring buoy 14' moving lower in the water column. It should be noted, however, that the mooring legs remain in a taut inverted catenary (TIC) configuration and a positive uplift force is imparted to anchors 10 by lower mooring lines 12. Even when BTM buoy 18 is offset from its equilibrium position by a current 20, lower anchor lines 12 do not contact the seafloor.

Figure 3:
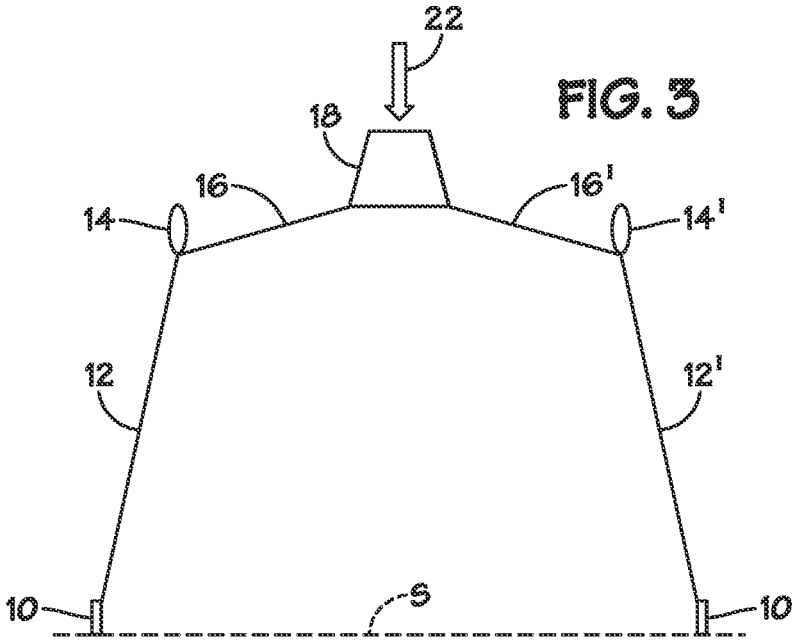
FIG. 3 is a schematic diagram of the disconnected BTM buoy illustrated in FIG. 1 with a flooded compartment in still water.

FIG. 3 illustrates the response of a mooring system according to the invention to an added vertical load and/or the loss of a portion of the buoyancy of BTM buoy 18 (as indicated by vector arrow 22). For example, the loss of buoyancy could be the result of one or more flooded compartments or to the gradual loss of buoyancy when using foam floatation. As shown in FIG. 3, as BTM buoy 18 moves lower, lower mooring lines 12 move more towards a vertical orientation while upper mooring lines 16 move more towards a horizontal orientation. This results in spring buoys 14 moving apart and somewhat higher in the water column. It should be noted that even when BTM buoy 18 assumes an equilibrium position that is lower in the water column, the mooring legs remain in a taut inverted catenary (TIC) configuration and a positive uplift force is imparted to anchors 10 by lower mooring lines 12. Lower mooring lines 12 remain off the seafloor.

Figure 4:
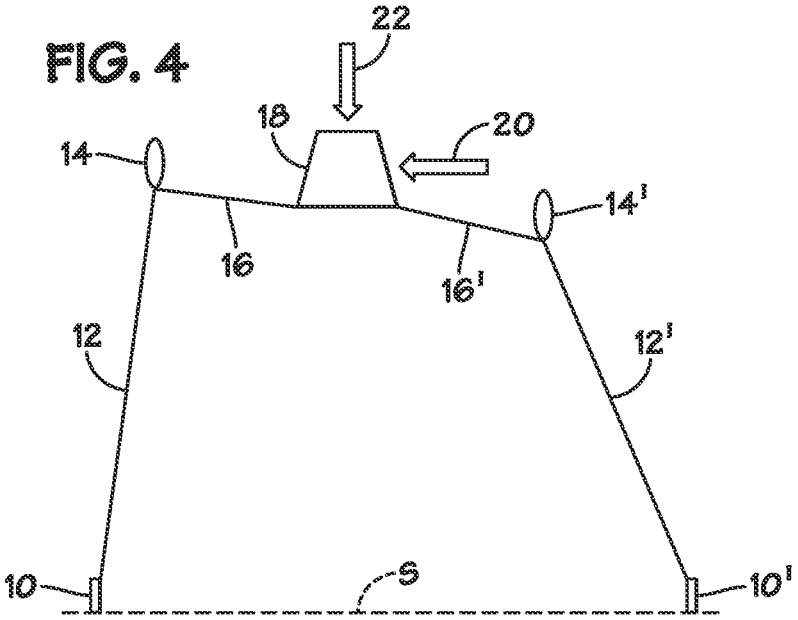
FIG. 4 is a schematic diagram of the disconnected BTM buoy illustrated in FIG. 1 with a flooded compartment and with a current load.

Referring now to FIG. 4, the mooring system depicted in FIG. 1 is shown under the influences of both a subsurface current (shown as current vector 20) and an added load or partial loss of buoyancy (shown as vector 22). Current vector 20 acts to displace BTM buoy 18 to the left in FIG.

4. These combined forces result in lower mooring line 12 becoming more vertical; spring buoy 14 rising; upper mooring line 16 providing some uplift force to buoy 18; lower mooring line 12' assuming a more acute angle (relative to the seafloor); and, spring buoy 14' moving lower in the water column. It should be noted, however, that the mooring legs remain at all times in a taut inverted catenary (TIC) configuration and a positive uplift force is imparted to anchors 10 by lower mooring lines 12. Even when BTM buoy 18 is offset from its equilibrium position by both a current (vector arrow 20) and a greater load or partial loss of buoyancy (vector arrow 22), lower anchor lines 12 do not contact the seafloor.

Figure 5:
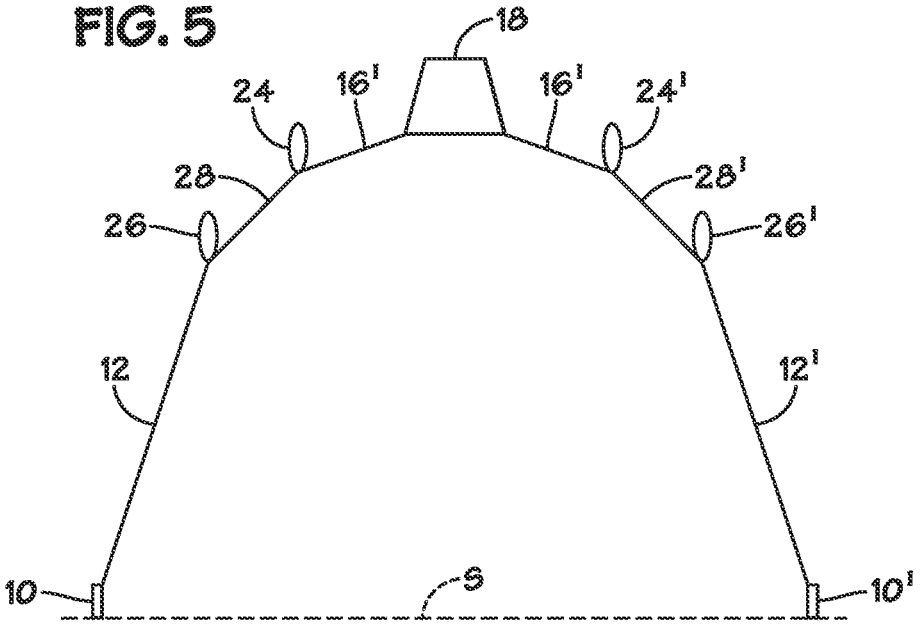
FIG. 5 is a schematic diagram of an embodiment of the invention having two underwater spring buoys on each mooring leg of a BTM buoy.

FIG. 5 schematically illustrates an alternative embodiment of the invention wherein a plurality of subsurface buoyancy elements are incorporated into each mooring leg. Seafloor S is shown as a dashed line in FIGS. 5 and 6. In the illustrated example, these subsurface buoyancy elements are in the form of upper and lower spring buoys 24 and 26, respectively. Intermediate mooring line 28 interconnects upper and lower spring buoys 24 and 26. Intermediate mooring line 28 may comprise or consist essentially of synthetic polymer fibers of the type used for lower mooring lines 12 and/or upper mooring lines 16. Yet other embodiments, may have one or more additional subsurface buoyancy elements situated between lower buoyancy element 26 and upper buoyancy element 24 with similar connecting mooring lines. Such additional subsurface buoyancy elements may be of the same type or a different type from the illustrated spring buoys 24 and 26. It will be appreciated that in the embodiment of FIG. 5, each of mooring lines 12, 28 and 16 assumes a substantially straight orientation at equilibrium.

Figure 6:
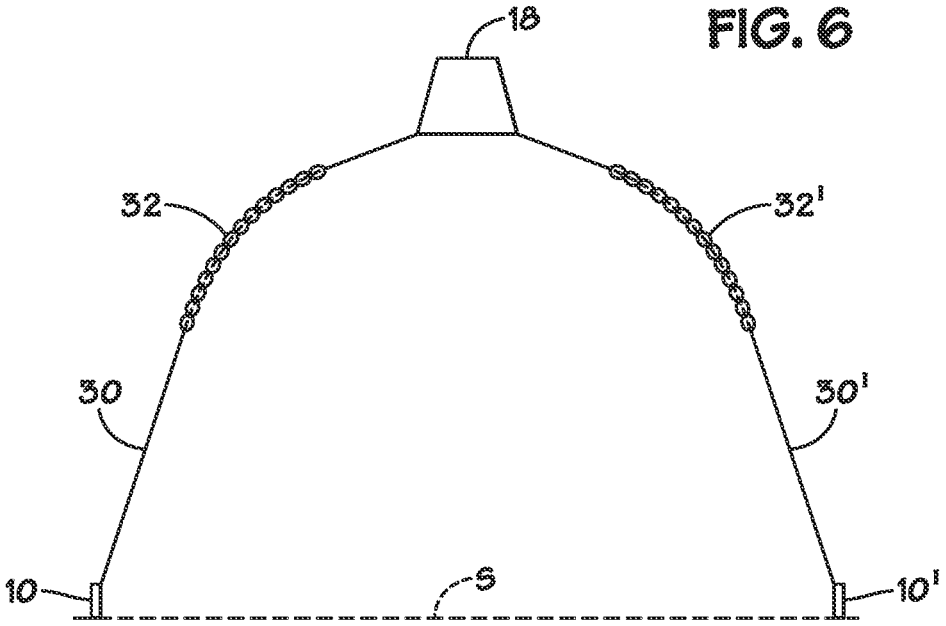
FIG. 6 is a schematic diagram of an embodiment of the invention having distributed buoyancy on each mooring leg of a BTM buoy.

FIG. 6 schematically illustrates another embodiment of the invention wherein a length of distributed subsurface buoyancy elements 32 are provided on a length of line between mooring lines 16 and 30. Buoyancy elements 32 may be a buoyant foam jacket surrounding a selected portion of line 32 which may have an upward curvature under equilibrium conditions. Other distributed buoyancy means known in the art may also be used. For example, a number of discreet foam buoyancy elements may be clamped or otherwise attached to mooring line 32.

A mooring system according to the invention may take the form of an embodiment that comprises a buoyant body; and, a plurality of mooring legs, each mooring leg comprising a seafloor anchor having a total holding power sufficient to remain fixed on the seafloor; a subsea buoyancy element; a first fiber rope segment that extends upwards from the seafloor anchor and is connected at a first end thereof to the seafloor anchor and at an opposing second end to the buoyancy element; and, a second fiber rope segment that extends generally upwards from the buoyancy element and is connected at a first end thereof to the buoyancy element and at an opposing second end to the buoyant body. Each mooring leg may be configured such that it exerts a positive uplift force on the seafloor anchor under all normal [undamaged] conditions. The buoyant body may be submersible and may have adjustable buoyancy. In certain embodiments, the buoyant body comprises a buoyant turret mooring (BTM) buoy. In certain embodiments, each seafloor anchor is positionable on the seafloor. In certain embodiments, each mooring leg is devoid of a ground chain.

In certain embodiments, the first and/or second fiber rope may comprise polyester fibers, DYNEEMA® ultra-high-molecular-weight polyethylene fibers, and/or aramid fibers. In certain embodiments, the buoyancy element comprises a subsurface spring buoy.

In certain embodiments, the surface vessel may be selected from the group consisting of tension leg platforms (TLP's), semi-submersibles, FPSO's and FSO's.

In yet other embodiments, a mooring system according to the invention comprises a buoyant body; and, a plurality of mooring legs, each mooring leg comprising a seafloor anchor having a total holding power sufficient to remain fixed on the seafloor; a first subsea buoyancy element; a second subsea buoyancy element; a first fiber rope segment that extends upwards from the seafloor anchor and is connected at a first end thereof to the seafloor anchor and at an opposing second end to the first buoyancy element; a second fiber rope segment that extends generally upwards from the first buoyancy element and is connected at a first end thereof to the first buoyancy element and at an opposing second end to the second buoyancy element; and, a third fiber rope segment that extends generally upwards from the second buoyancy element and is connected at a first end thereof to the second buoyancy element and at an opposing second end to the buoyant body. Each mooring leg may be configured such that it exerts a positive uplift force on the seafloor anchor under all normal [undamaged] conditions.

In still further embodiments, a mooring system according to the invention may comprise a buoyant body; and, a plurality of mooring legs, each mooring leg comprising a seafloor anchor having a total holding power sufficient to remain fixed on the seafloor; a mooring line that extends generally upwards from the seafloor anchor and is connected at a first end thereof to the seafloor anchor and at an opposing second end to the buoyant body; and, one or more buoyancy elements on a selected portion of the mooring line, wherein each mooring leg is configured such that it exerts a positive uplift force on the seafloor anchor under all normal [undamaged] conditions. The one or more buoyancy elements may comprise a buoyant jacket substantially surrounding the selected portion of the mooring line and/or may comprise buoyancy cans or buoyant foam elements attached to the selected portion of the mooring line.

The foregoing presents a particular embodiment of a system embodying the principles of the invention. Those skilled in the art will be able to devise alternatives and variations which, even if not explicitly disclosed herein, embody those principles and are thus within the scope of the present invention as literally and equivalently covered by the following claims.

What is claimed is:

1. A mooring system comprising:

a buoyant body; and, a plurality of mooring legs, each mooring leg comprising a seafloor anchor having a total holding power sufficient to remain fixed on the seafloor;

a subsea buoyancy element;

a first mooring line segment that extends upwards from the seafloor anchor and is connected at a first end thereof to the seafloor anchor and at an opposing second end to the buoyancy element; and, a second mooring line segment that extends generally upwards from the buoyancy element and is connected at a first end thereof to the buoyancy element and at an opposing second end to the buoyant body such that the second mooring line segment provides some uplift force to the subsea buoyancy element, wherein each mooring leg is configured such that it exerts a positive uplift force on the seafloor anchor under all offset and vertical loading conditions of the buoyant body.

2. The mooring system recited in claim 1 wherein the buoyant body is submersible.

3. The mooring system recited in claim 1 wherein the buoyant body has adjustable buoyancy.

4. The mooring system recited in claim 1 wherein the buoyant body comprises a buoyant turret mooring (BTM) buoy.

5. The mooring system recited in claim 1 wherein each seafloor anchor is positionable on the seafloor.

6. The mooring system recited in claim 1 wherein each mooring leg is devoid of a ground chain.

7. The mooring system recited in claim 1 wherein the first mooring line segment comprises polyester fibers.

8. The mooring system recited in claim 1 wherein the second mooring line segment comprises polyester fibers.

9. The mooring system recited in claim 1 wherein the first mooring line segment comprises aramid fibers.

10. The mooring system recited in claim 1 wherein the second mooring line segment comprises aramid fibers.

11. A mooring system for a surface vessel comprising:

a plurality of mooring legs, each mooring leg comprising a seafloor anchor having a total holding power sufficient to remain fixed on the seafloor;

a subsea buoyancy element;

a first mooring line segment that extends upwards from the seafloor anchor and is connected at a first end thereof to the seafloor anchor and at an opposing second end to the buoyancy element; and, a second mooring line segment that extends generally upwards from the buoyancy element and is connected at a first end thereof to the buoyancy element and at an opposing second end to the surface vessel such that the second mooring line segment provides some uplift force to the subsea buoyancy element, wherein each mooring leg is configured such that it exerts a positive uplift force on the seafloor anchor under all offset and vertical loading conditions of the surface vessel.

12. The mooring system for a surface vessel recited in claim 11 wherein the surface vessel is selected from the group consisting of tension leg platforms (TLPs), semi-submersibles, FPSO's and FSOs.

13. The mooring system recited in claim 11 wherein each seafloor anchor is positionable on the seafloor.

14. The mooring system recited in claim 11 wherein each mooring leg is devoid of a ground chain.

15. The mooring system recited in claim 11 wherein the first mooring line segment comprises polyester fibers.

16. The mooring system recited in claim 11 wherein the second mooring line segment comprises polyester fibers.

17. The mooring system recited in claim 11 wherein the first mooring line segment comprises aramid fibers.

18. The mooring system recited in claim 11 wherein the second mooring line segment comprises aramid fibers.

19. The mooring system recited in claim 11 wherein the first mooring line segment comprises ultra-high-molecular-weight polyethylene fibers.

20. The mooring system recited in claim 11 wherein the second mooring line segment comprises ultra-high-molecular-weight polyethylene fibers.

21. A method for mooring a buoyant turret mooring (BTM) buoy comprising:

installing a plurality of anchors in the seafloor at preselected positions, each mooring legs, each a seafloor anchor having a total holding power sufficient to remain fixed on the seafloor;

providing an equal plurality of subsea buoyancy elements;

connecting a first mooring line segment at a first end thereof to each seafloor anchor, the first mooring line segment extending upwards from the seafloor anchor and connected and at an opposing second end to a buoyancy element; and, connecting a second mooring line segment at a first end thereof to the buoyancy element that extends generally upwards from the buoyancy element and is connected and at an opposing second end to the BTM buoy such that the second mooring line segment provides some uplift force to the subsea buoyancy element, wherein a positive uplift force is exerted on each of the seafloor anchors under all offset and vertical loading conditions of the BTM buoy.

22. A mooring system comprising:

a buoyant body; and, a plurality of mooring legs, each mooring leg comprising a seafloor anchor having a total holding power sufficient to remain fixed on the seafloor;

a first subsea buoyancy element;

a second subsea buoyancy element;

a first mooring line segment that extends upwards from the seafloor anchor and is connected at a first end thereof to the seafloor anchor and at an opposing second end to the first buoyancy element;

a second mooring line segment that extends generally upwards from the first buoyancy element and is connected at a first end thereof to the first buoyancy element and at an opposing second end to the second buoyancy element such that the second mooring line segment provides some uplift force to the first subsea buoyancy element; and, a third mooring line segment that extends generally upwards from the second buoyancy element and is connected at a first end thereof to the second buoyancy element and at an opposing second end to the buoyant body such that the third mooring line segment provides some uplift force to the second subsea buoyancy element, wherein each mooring leg is configured such that it exerts a positive uplift force on the seafloor anchor under all offset and vertical loading conditions of the buoyant body.

23. A mooring system comprising:

a buoyant body; and, a plurality of mooring legs, each mooring leg comprising a seafloor anchor having a total holding power sufficient to remain fixed on the seafloor;

a taut mooring line that extends generally upwards from the seafloor anchor and is connected at a first end thereof to the seafloor anchor and at an opposing second end to the buoyant body; and, one or more buoyancy elements on a selected length of the mooring line, wherein each mooring leg is configured such that it exerts a positive uplift force on the seafloor anchor under all offset and vertical loading conditions of the buoyant body.

24. The mooring system recited in claim 23 wherein the one or more buoyancy elements comprise a buoyant jacket substantially surrounding the selected length of the buoyant mooring line.

25. The mooring system recited in claim 23 wherein the one or more buoyancy elements comprise buoyancy cans or foam buoys attached to the selected length of the mooring line.

* * * * *